US005180280A

United States Patent [19]

Honda

[11] Patent Number: 5,180,280

[45] Date of Patent: Jan. 19, 1993

[54] CENTRIFUGAL PUMP

[76] Inventor: Toshiharu Honda, 20-103, 5-4, Yashio, Shinagawa-ku, Tokyo, Japan

[21] Appl. No.: 624,403

[22] Filed: Dec. 7, 1990

[30] Foreign Application Priority Data

May 28, 1990 [JP] Japan ..... 2-55823[U]
Sep. 13, 1990 [JP] Japan ..... 2-243604

[51] Int. Cl.[5] ..... F01D 1/02

[52] U.S. Cl. ..... 415/206; 415/182.1; 416/223 B

[58] Field of Search ..... 415/182.1, 203, 206, 415/207, 196, 212.1, 119; 416/223 B, 223 R, 91, 92, 90 R

[56] References Cited

U.S. PATENT DOCUMENTS

| | | | |
|---|---|---|---|
| 2,268,358 | 12/1941 | Turner | 415/212.1 |
| 2,291,478 | 7/1942 | La Bour | 415/182.1 |
| 3,051,312 | 8/1962 | Arge | 415/212.1 |
| 3,260,216 | 7/1966 | Mann et al. | 415/206 |
| 3,519,365 | 7/1970 | Conhagen | 415/182.1 |
| 3,647,314 | 3/1972 | Laessig | 415/206 |

FOREIGN PATENT DOCUMENTS

| | | | |
|---|---|---|---|
| 924188 | 1/1955 | Fed. Rep. of Germany | 415/206 |
| 765554 | 6/1934 | France | 415/206 |
| 1116535 | 5/1956 | France | 415/206 |
| 2233 | of 1878 | United Kingdom | 415/206 |

*Primary Examiner*—Thomas E. Denion
*Attorney, Agent, or Firm*—Kane, Dalsimer, Sullivan, Kurucz, Levy, Eisele and Richard

[57] ABSTRACT

A fluid transfer apparatus has a pump housing, which is provided with a fluid intake opening, freely rotatable impeller with an integral base section and a fluid discharge opening. The impeller has several integral vane portions, which contain fluid channel routes within, extending radially from the base section. The liquid is drawn by the impeller into the pump housing, and enters the base section through fluid suction port of the impeller, and passes through the fluid channels of the vane portions to be discharged through the discharge opening of the pump housing.

2 Claims, 7 Drawing Sheets

CENTRIFUGAL PUMP

FIELD OF THE INVENTION

This invention relates to a centrifugal pump for transporting fluids such as water, liquefied fuel, liquefied gas, wet steam and other liquid bodies.

BACKGROUND ART

Fluid pumps such as a sump pump 1 shown in FIG. 1 consist essentially of a housing 2, which houses a pumping cavity 2*c*, a freely rotatable driving shaft 3 located within the pumping cavity and an impeller 4 fixed to one end of the driving shaft.

The housing 2 is provided with an intake opening 2*a* positioned directly in line with the driving shaft 3 and an discharge opening 2*b* positioned approximately tangentially to the disc shaped impeller 4.

The cross sectional area of the discharge opening 2*b* gradually increases towards the exit opening to serve the function of a diffuser.

Also the impeller 4 is provided with a base section 4*a* which serves as the connecting section with the driving shaft 3, and a number of vanes 5 extending approximately radially from the base section 4*a*. The vanes are not connected to the shaft, as shown in FIG. 2, and is known as the open-type vanes.

This type of sump pump operates by the action of the rotatable shaft 3 which moves the impeller 4 to cause the water contained inside the housing 2 to be moved from the base section 4*a* and to be hurled against the housing walls, by the centrifugal force. Continued rotation causes an increase in the water pressure, leading to discharging of the water from the discharge opening 2*b* and, at the same time, lifting of additional volume of water into the intake opening 2*a*.

Such a design of the impeller leads to lowering of the pumping efficiency because the pressured water contained in a vane section between the adjacent vanes 5 tends to leak in the direction of 4*b* into the adjacent section through the small clearance between the vanes 5 and the inside of the pumping chamber, shown in FIG. 1. It should be remembered that this clearance itself is, indeed, a part of the fluid passage routes in the conventional open-type vane design and it cannot be eliminated.

In order to solve such problems, an impeller 6 of a design shown in FIG. 3 and another impeller 7 of a design shown in FIG. 4 have been proposed.

The impeller 6 shown in FIG. 3 is a semi-open type and has a disc-shaped solid base section 8 which extends beyond the vanes so as to contain the water more effectively inside the vane section. The objective is to prevent the leaking of water in between the vane sections.

The impeller 7 shown in FIG. 4 is a closed type and has an additional closure in the form of a shroud covering 9 over the vanes 5 so as to seal in the water inside the vane sections. The same objective as in the previous design is retained, and that is to prevent the leaking of water between the vane sections.

However, the presence of the extended base 8 and the shroud cover 9, results in the creation of a stagnant water region between the vanes and the impeller housing 2, and the water in this region then effectively becomes isolated from the rotational action of the impeller.

Accordingly, the hydrostatic pressure on one side of the impeller increases, resulting in the development of a thrust loading on the impeller 6, which obstructs smooth rotation of said impeller 6.

The resulting viscous drag between the housing 2 and the base 8 increases also and affects the pumping efficiency of the impeller 6.

In the case of the impeller 7, since there are effectively two protective shrouds, 8 and 9, the thrust loading on the impeller 7 is decreased. However, because of an increase in the opposing surface areas between the impeller surface and the interior surface area of the pump housing, there is a corresponding increase in the viscous drag, which creates one reason for the loss of pumping efficiency.

Furthermore, the impeller 7 is prone to creating a pressure differential between the inside and outside of the intake opening 7*a*, and this pressure differential creates a phenomenon of reverse flow of the fluid from inside the pumping chamber 2*c*.

Returning to FIG. 1, the water driven by the centrifugal force travels in the tangential direction along the inside surface of the housing 2, and is discharged from the discharge opening 2*b*.

To improve the pumping efficiency of the impeller 1, the following improvements to said impeller are being sought.

That is, it can be recognized that there are two energy conservation requirements, which are represented by the ratio of pressure energy and the residual kinetic energy of the pressurized water, at the discharge opening 2*b*. On the one hand, it is desirable to maintain the water pressure energy right up to the discharge opening, and on the other, to convert as much of the kinetic energy of the moving water into pressure energy, except those energy components which can increase the average exit velocity of the discharging water.

This is explained in reference to data presented in FIG. 6 which shows the relationship between the pressure and the flow volume. The static pressure $P_0$ at the exit region of the impeller 4 is relatively insensitive to the flow volume. On the other hand, theoretical calculations demonstrate that both the static pressure $P_1'$, at the entry region to the discharge opening 2*b*, and the exit pressure $P_2$, at the final exit opening, decrease with flow volume. In the conventional sump pump 1, the pressure $P_1$ decreases even more rapidly with the flow volume than the calculations indicate.

The reason for this phenomenon is considered to be the following.

The main body of the fluid flowing into the discharge opening 2*b* is generally flowing tangentially to the inner surface of the housing 2, as illustrated in FIG. 5, however, the remaining portion of the fluid which flows close to the inner surface of the housing 2 experiences cavitation when it encounters a protrusion A disposed on the inner portion of the discharge opening 2*b* of the housing 2. Thus, there is an effective narrowing of the opening area of the entry region of the discharge opening 2*b*, which leads to an increase in the fluid velocity at this location.

SUMMARY OF THE PRESENT INVENTION

An object of the present invention is to improve the pumping efficiency of an impeller by preventing the leaking of fluid between the vane sections and by decreasing the viscous drag between the housing and the impeller.

Another object of the present invention is to reduce the thrust loading on the impeller.

Still another object of the present invention is to prevent the reverse flow of fluid within the pumping chamber.

The above objectives are achieved by the invented pump by including the following design features.

The pump comprises a pump housing having a fluid intake opening, a fluid discharge opening and a freely rotatable impeller housed therein; the impeller has a base section and a plurality of vane portions extending radially therefrom; the base section is adapted to form a fluid intake opening leading to the fluid intake opening and said vane portions are adapted to form a discharge fluid channel route linked with the fluid discharge opening.

The invented pump provides the following operational features and results.

The invented pump prevents intrafluid mixing of the fluid being transported by providing two completely separate fluid paths for the fluid travelling in the intake-discharge fluid circuit.

The vane portions are designed for effective fluid motion near the region of the base section so as to minimize the rise in fluid pressure in the vicinity of said region.

By this design, the pumping efficiency is raised because the pressure differential is reduced, between the pressures in the base region in the pumping chamber and in the intake opening of the impeller, to prevent reverse flow of intake fluid.

By balancing the surface areas of the opposing top and bottom sides of the impeller body to be approximately the same, the pressure differential is reduced, thereby also reducing the axial thrust on the impeller. This design is also effective in reducing the viscous drag caused by the rotation of the impeller.

The invented pump greatly increases the degree of design freedom by reducing the structural restrictions placed on the axial movement of the impeller, and by easing the clearance requirements for the space between the impeller and the interior of the pump housing Still another objective of the present invention is to prevent cavitation caused by the fluid as it enters discharge opening from the pumping chamber.

The above objective is achieved by the invented pump by including the following structural features.

The pump has a pump housing provided with a fluid intake opening, a fluid discharge opening and a pumping chamber disposed therein, and includes a freely rotatable impeller. The pumping chamber is connected with the fluid intake opening and also with the fluid discharge opening. The interior surface of the pumping chamber is shaped so as to maintain a predetermined distance with the outermost boundary of the rotatable impeller.

At the fluid discharge opening, a diffuser is provided to direct the discharging fluid from the interior of the pumping chamber to the outside of the pump housing. This diffuser is disposed between said outermost boundary and said interior of the housing, and includes a fluid guiding portion having a fluid entry opening directly facing the fluid flow direction. The diffuser is further provided with a fluid exit route which is bent at right angles to the fluid flow direction.

The invented pump provides the following operational features and results.

The diffuser provides smooth transfer of fluid without substantially disturbing the fluid flow lines, because the fluid entry opening is disposed approximately perpendicular to the fluid flow direction thereby to effect smooth entry of fluid into the guiding route.

By suppressing fluid turbulence at the entry region, pressure fluctuation in this region is minimized, leading to conservation of the kinetic energy of the fluid and ultimately to an increase in the pumping efficiency.

DETAILED DESCRIPTION OF THE PREFERRED EMBODIMENTS

Preferred embodiments of the present invention are explained in the following in reference to the figures presented above.

Figure 2:
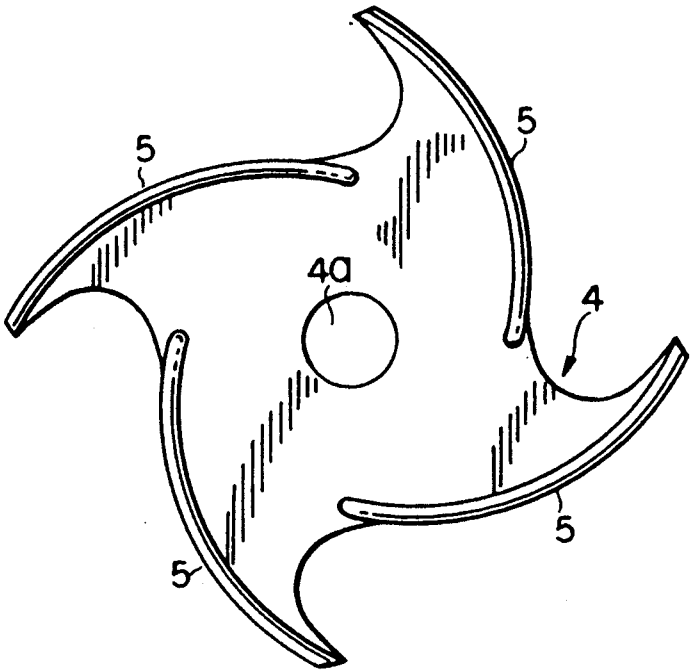
FIG. 2 PRIOR ART
FIG. 2 is a top view of a conventional impeller.
Figure 1:
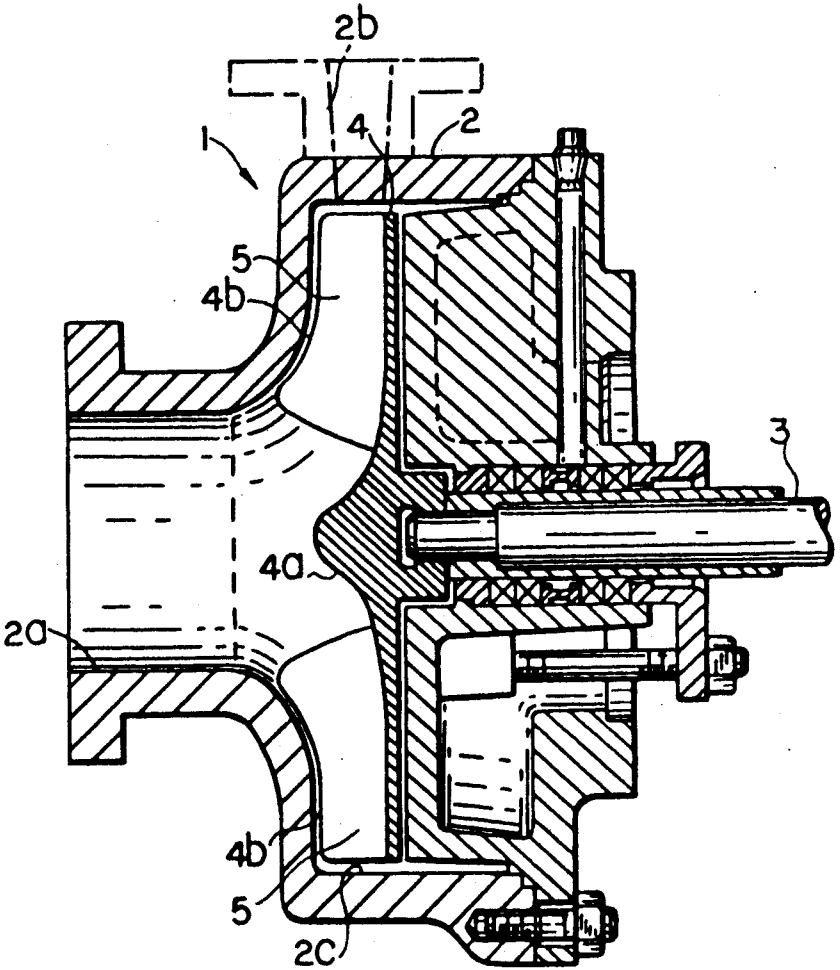
FIG. 1 PRIOR ART
FIG. 1 is a cross sectional view of a conventional fluid transfer pump.
Figure 4:
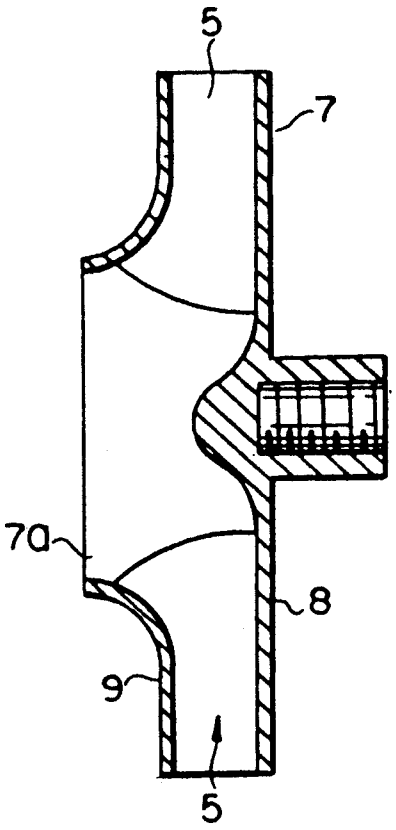
FIG. 4 PRIOR ART
FIG. 4 is a top view of still another example of the conventional impeller.
Figure 3:
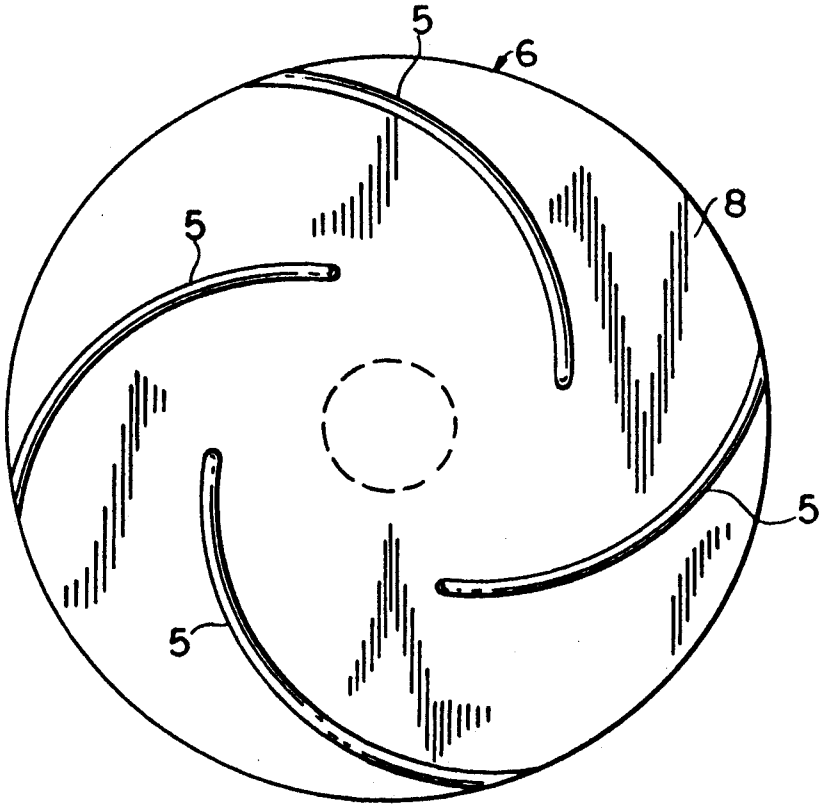
FIG. 3 PRIOR ART
FIG. 3 is a top view of another example of the conventional impeller.
Figure 5:
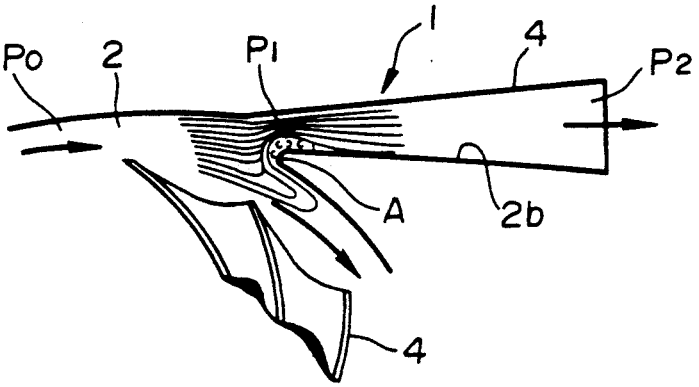
FIG. 5 is an illustration of the top view of the main features of the fluid flow patterns in the vicinity of a discharge opening of the conventional pump.
Figure 6:
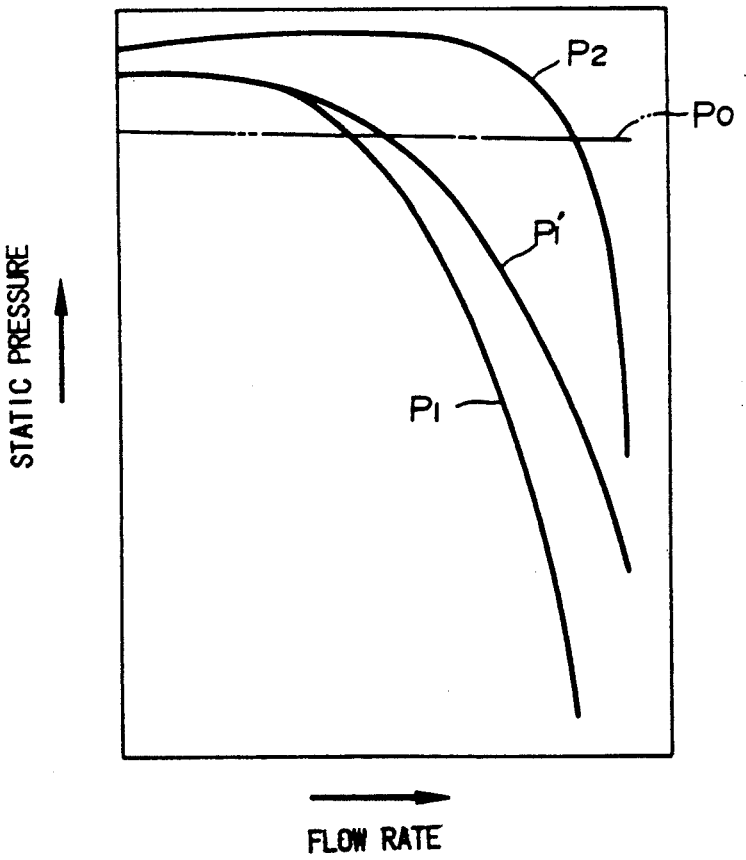
FIG. 6 is a graph showing the relationship between the fluid pressure and the fluid flow volume at the indicated locations in the pumping chamber.
Figure 7:
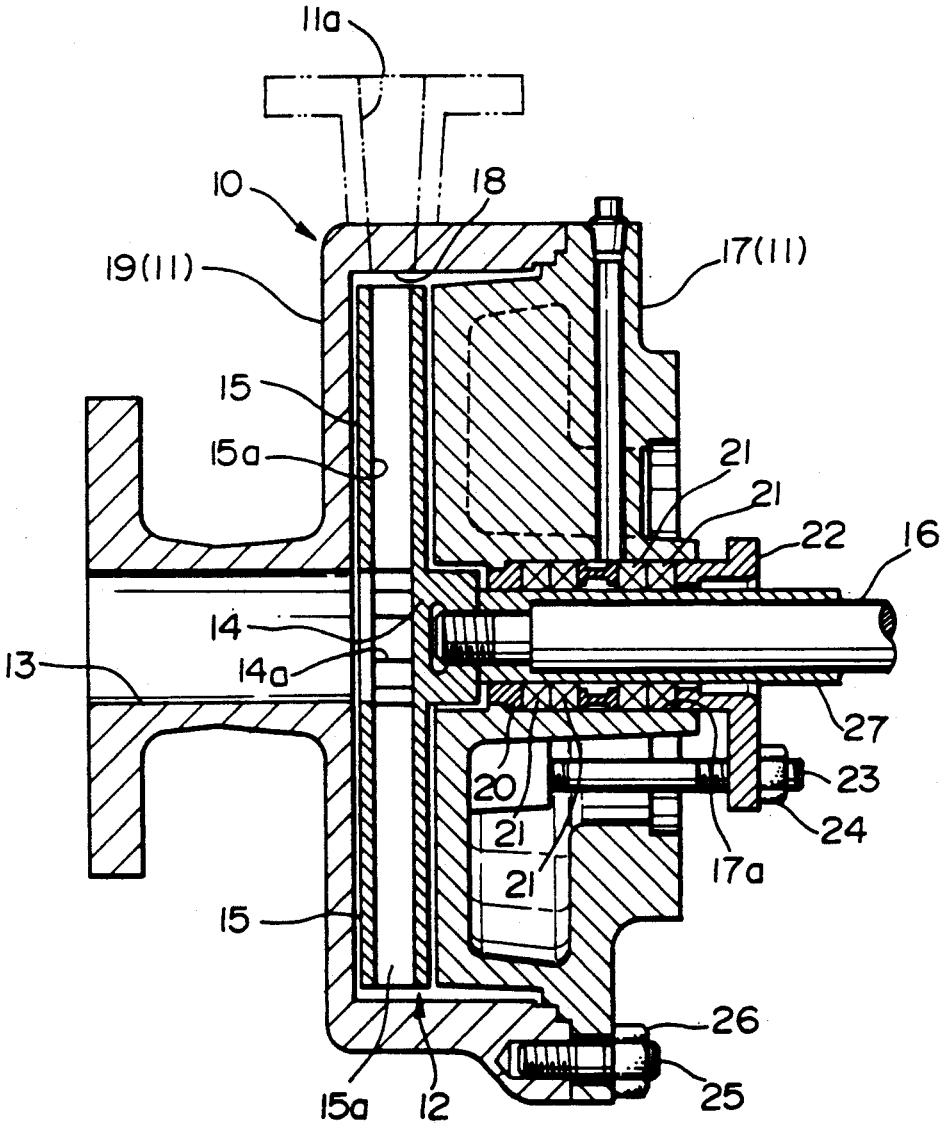
FIG. 7 is a cross sectional view of a first preferred embodiment of the present invention.

In reference to FIG. 7, a centrifugal pump 10, housed in a housing 11 rotates an impeller 12, to expel, by the action of the centrifugal force, the fluid from inside the housing 11 to a discharge opening 11*a* while simultaneously transferring the fluid from a source to the housing 11. The impeller 12 consists essentially of a base section 14 centrally located within the impeller and located axially in line with both a fluid intake opening 13 and a fluid suction port 14*a*; and a plurality of vane portions 15 which extend radially from said central section 14 to form a fluid channel route 15*a* which connects to said intake opening 13.

The structural details of the above centrifugal pump is explained in the following with reference to FIG. 7.

The main components of the housing 11 are an outer housing 19 which houses an inner housing 17 between which is formed a disc shaped pumping chamber 18. A freely rotatable driving shaft 16 is inserted through a bore hole 17*a* disposed centrally on the outer housing 19.

The bore hole 17*a* is provided with a ring bushing 20 positioned to prevent shifting of the impeller 12 into the pumping chamber, and is sealed with more than one packing 21 on the side away from the pumping chamber 18. Said packing 21 is held in between said bushing 20 with a ring retainer 22.

Said retainer 22 is fixed in place by means of through bolts 23, one end of which is threaded into the inner housing 17, and corresponding nuts 24 to enable tightening of the packing through the retainer in the direction of said bushing 20.

The outer housing 19 is detachable by means of bolts 25 and nuts 26 from the inner housing 17.

Figure 8:
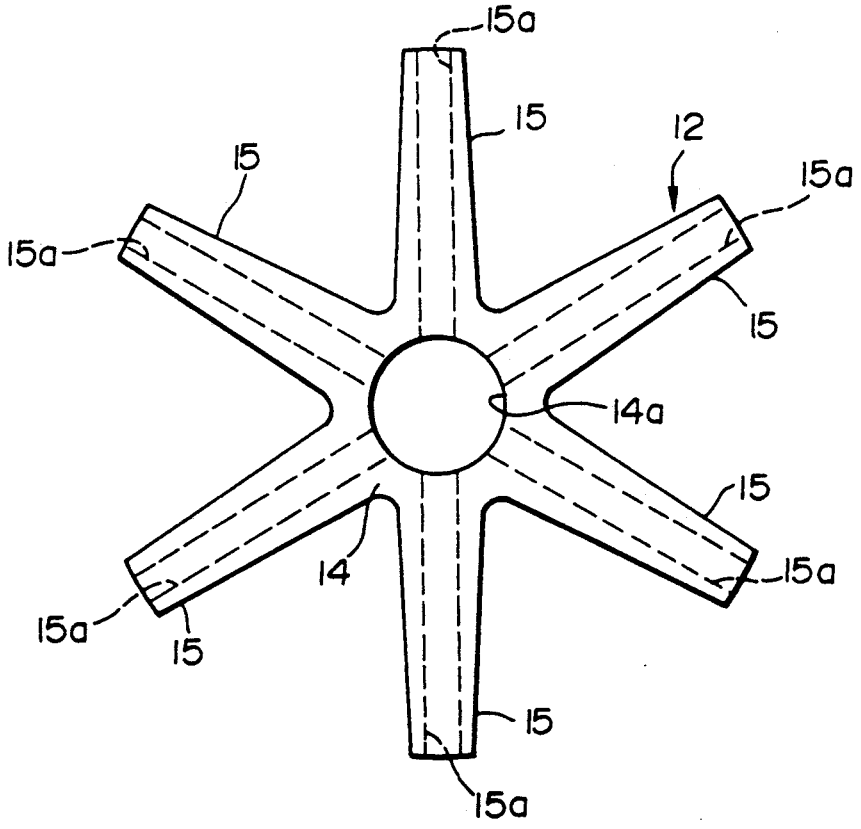
FIG. 8 is a top view of an impeller in the present invention.

In the preferred embodiment shown in FIGS. 7 and 8, the impeller 12 is provided with six vane portions 15, extending radially from the base section 14 and disposed at equal radian intervals.

The cross sectional shape in the tangential plane of the vane portion 15 is a square shape while that in the radial plane is a tapered four sided shape, because the dimension of the vane portion 15, in the axial direction, decreases gradually away from the base section 14.

On the other hand, the cross sectional shape of the fluid channel route 15*a* formed in the interior of the vane portion 15 remains a square shape throughout its passage path starting from the base section 14 and ending at the tip of the vane portion 14.

In further reference to FIG. 7, the driving shaft 16 is encased in a sleeve collar 27, which passes through sad bushing 20, packing 21 and retainer 22 and extends into the inner housing 17, to provide water tight yet freely rotatable movement.

The above system of transferring fluid is put into a continuous operation by attaching a continually rotatable means such as an electric motor to said shaft 16 thereby causing the impeller 12 to rotate to impart centrifugal force to the fluid present within the housing 11 to be expelled through fluid discharge opening 11*a* while simultaneously siphoning in fluid from the intake opening 13.

More specifically, as a result of the above rotating action of the impeller 12, the fluid contained within the fluid channel route 15*a* is caused to move, by the action of the centrifugal force, from the base section 14 towards the tip of the vane portion 15.

At the same time, the fluid filling the pumping chamber 18 is also pushed in the direction of the rotation of the impeller by the vertical side walls of the rotatable vane portion 15 towards the inside walls of the pumping chamber 18 to be expelled out of the housing 11 through the discharge opening 11*a*.

The expelling of the fluids from the fluid channel route 15 and the pumping chamber 18 decreases the fluid pressure in the vicinity of the base section 14, which further prompts withdrawing of external fluid into the interior spaces of the housing 11 and the impeller 12.

Continuous discharging of fluid from the housing 11 results when the above process is repeated.

By keeping the fluid flow paths in the impeller in separate compartments as described above, it is possible to prevent intrafluid interference to disturb a smooth flow of discharging fluid.

It is further noted that the design of the impeller 12 promotes efficient removal of the pumping chamber fluid, even from the vicinity of the base section 14, thus preventing the pressure rise in the narrow clearance space between the interior of the pump housing and the impeller. Furthermore, the low radial pressure difference, within this clearance space, promotes efficient flow of fluid from the pumping chamber 18 to the fluid suction port 14*a*, and thereby reducing the pressure differential and consequently the thrust pressure on the impeller 12.

Furthermore, because the respective surface areas of the impeller 12 and the housing 11 (both inner 17 and outer 19 pump housings) are kept low, the fluid drag accompanying the rotation of the impeller 12 can also be kept low.

All of the above inter-related effects combine to produce a highly efficient centrifugal pump.

Because the axial thrust pressure is reduced, there is less need for controlling the axial shift of the impeller 12, and also there is less stringent demand for the dimensional clearance between the impeller 12 and the housing 11, contributing to greater freedom in manufacturing design.

In this preferred embodiment, six vane portions 15 were included, but other choices are also permissible.

With respect to the design of the vane portions 15, they need not be restricted to radially straight design as adapted in this preferred embodiment. The vane portions 15 could be inclined at an angle other than right angles in the direction opposite to the rotation direction, or they could be curved along the entire length or just locally.

Further, the cross sectional shape of the fluid channel route was made to be square, but other shapes such as oval or ellipsoidal shapes can be adapted.

In the following, other preferred embodiments of this invention are described in reference to FIGS. 9 to 11. In the descriptions, same components and parts are referred to by the same numerals, and explanations are omitted wherever applicable.

Figure 9:
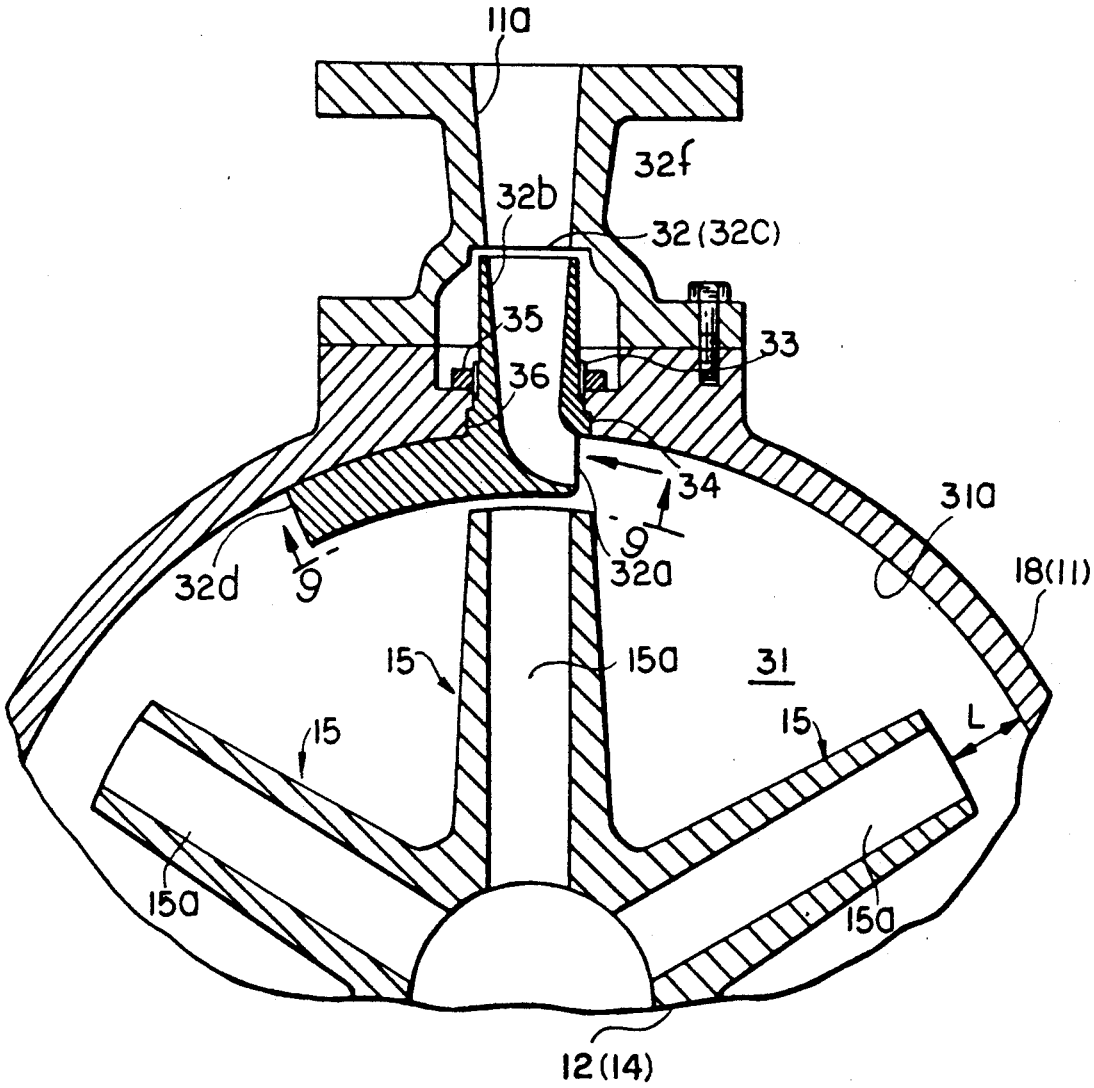
FIG. 9 is a detailed top view of the key elements of another preferred embodiment of the present invention.
Figure 10:
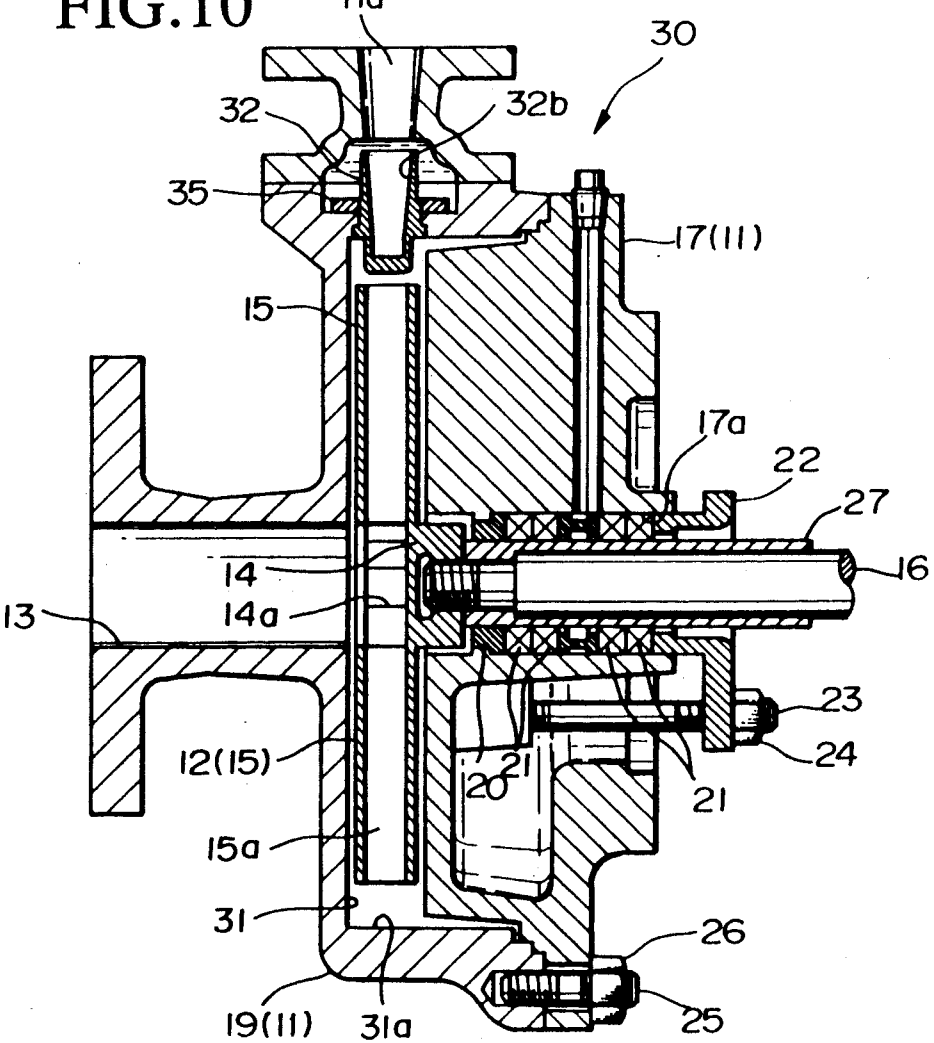
FIG. 10 is a detailed side view of the key elements of still another preferred embodiment of the present invention.

In a second preferred embodiment of this invention, the centrifugal pump 30, shown in FIG. 9, has a housing 11, and an approximately circular pumping chamber 31 whose inner surface 31*a* is separated by a given spacing L from the surface defined by the rotatable impeller 12. Said housing 11 has a fluid discharge opening 11*a* including a protruding diffuser 32 which is disposed between the impeller 12 and the interior peripheral surface (the interior surface) 31*a* of the pumping chamber 31. Said diffuser 32 is provided with a curved fluid channel route 32*b* disposed approximately perpendicularly to a tangent line to said interior surface 31*a*, and whose exit opening 32*f* is aligned with the fluid discharge opening 11*a*, and the entry opening 32*a* is bent in the direction of the rotation of the impeller 12.

The details of the construction features of this diffuser are explained in the following.

The main functional parts of the diffuser 32 are a guiding portion 32*c* which passes radially through the wall of the outer housing 19 and a streaming portion 32*d* which is connected to said guiding portion 32*c* and is disposed along the interior surface of the pumping chamber 31 extending in the direction of the impeller 12.

The entry opening 32*a* is disposed directly opposite to the streaming portion 32*d*.

Figure 11:
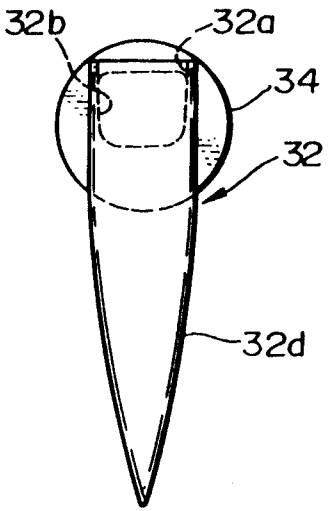
FIG. 11 is a cross sectional view of a section taken along a line XI—XI in FIG. 9.

Further, the cross sectional shape of the streaming portion 32*d* viewed radially becomes smaller in the downstream section and assumes a streamlining profile as shown in FIG. 11.

The diffuser 32 is detachably attached to the wall of the housing 11 by means of a threaded section 33 on said diffuser which passes through a holed section of said wall, and by holding said wall in between the flange section 34 of said diffuser and a nut 35.

Said flange section 34 is fitted into a shallow depression 36 provided on the interior wall of said discharge opening 11*a*.

The centrifugal pump 30 as described above is operated as follows. A rotating means such as an electric motor is connected to the shaft 16 to rotate said impeller 12 and the fluid inside the housing 11. The fluid is driven along the interior peripheral surface 31*a* of a pumping chamber 31, by centrifugal force, into said diffuser 32 to be discharged. Simultaneously, fluid from an external source is transferred into the housing 11 through an intake opening 13, resulting in a continuous transfer movement of fluid.

More specifically, as a result of the above rotatable action of the impeller 12, the fluid contained within the fluid channel route 15*a* is caused to move, by the action of the centrifugal force, from the base section 14 towards the tip of the vane portion 15.

At the same time, the fluid filling the pumping chamber 31 is also pushed by the leading side walls of the rotatable vane portion 15 towards the inside walls of the pumping chamber 31 to be expelled out of the housing 11 through said diffuser 32.

The expelling of the fluids from the fluid channel route 15*a* and the pumping chamber 31 decreases the fluid pressure in the vicinity of the base section 14, which further prompts withdrawing of external fluid into the interior spaces of the housing 11 and the impeller 12 through said fluid intake opening 13 and the fluid suction port 14*a*.

Continuous discharging of fluid from the housing 11 results when the above process is repeated.

The action of the diffuser 32 is explained in the following. The entry opening 32*a* of the diffuser 32 is placed approximately at right angles to the direction of flow of the fluid inside the housing 11, and accordingly, the direction of the discharging fluid flow in the vicinity of the entry opening 32*a* coincides approximately with that of the main flow of the fluid inside the pumping chamber 31.

By means of the arrangement as described above, the disturbance of the flow patterns in the vicinity of the entry opening 32*a* is kept to a minimum, and consequently, the generation of cavities in this region is minimized and accordingly, the continuity of the fluid velocity is maintained.

Thusly, the smooth flow pattern of the discharging fluid as well as the prevention of the pressure drop of the discharging fluid lead to conservation of the kinetic energy of the discharging fluid, and to an improvement in the pumping efficiency.

The remainder of the discharging fluid which cannot enter the diffuser 32 flows downstream over the exterior surface of said diffuser 32.

The profile of the diffuser 32 is streamlined in the downstream direction so as to avoid a disturbance in the fluid flow pattern to provide overall continuity in the fluid velocity within the pump housing.

The above provision assures that there will be the least amount of disturbance in the flow pattern of the discharging fluid entering the entry opening 32*a* of said diffuser 32.

The overall design improvement considerations represented by the aforementioned preferred embodiments demonstrate a cooperating effect among different sets of complex variables involved in fluid transfer process to achieve conservation of the kinetic energy of the discharging fluid to achieve an overall improved efficiency of the centrifugal pump of the present invention.

What is claimed is:

1. A centrifugal pump comprising:

(a) a cylindrical housing defining an internal space, the housing having a fluid intake opening and a fluid discharge opening and the internal space communicating with the outside space through the openings;

(b) an impeller retained rotatably in the center of the housing wherein said impeller and an interior peripheral surface of said internal space is separated from each other by predetermined distance;

(c) a diffuser, having a portion which protrudes from the interior peripheral surface of said internal space, having a fluid entry opening which is disposed at an upstream-side surface of the portion, and having a fluid exit opening communicating with said fluid discharge opening; and (d) wherein said fluid exit opening is provided with a fluid guiding portion on which is formed a detaching means for detachably attaching said diffuser to said pump housing.

2. A centrifugal pump according to claim 1, wherein the portion of said diffuser, which protrudes from the interior peripheral surface, is provided with a streaming portion disposed directly downstream from said fluid entry opening; and the streaming portion having a cross section shape which becomes smaller in the down stream section when viewed radially.

* * * * *